United States Patent [19]

Kane et al.

[11] 4,027,621

[45] June 7, 1977

[54] DEVELOPING SYSTEM FOR ELECTROSTATIC REPRODUCTION MACHINES

[75] Inventors: Thomas J. Kane, Rochester; Richard H. Dennie, Macedon, both of N.Y.

[73] Assignee: Xerox Corporation, Stamford, Conn.

[22] Filed: Mar. 14, 1975

[21] Appl. No.: 558,596

[52] U.S. Cl. ..... 118/5; 118/646

[51] Int. Cl.[2] ..... G03G 15/08

[58] Field of Search ..... 118/5, 600, 637; 355/3 DD, 3 R; 34/DIG. 4, 39, 50, 55

[56] References Cited

UNITED STATES PATENTS

| | | | |
|---|---|---|---|
| 2,919,672 | 1/1960 | Benn et al. | 118/637 X |
| 3,424,131 | 1/1969 | Aser et al. | 118/637 |
| 3,533,168 | 10/1970 | Aoki et al. | 34/50 |
| 3,634,007 | 1/1972 | Verderber et al. | 355/3 R |
| 3,677,632 | 7/1972 | MacDonald, Jr. | 355/3 R |
| 3,814,516 | 6/1974 | Whited | 118/637 X |
| 3,817,616 | 6/1974 | Whited | 355/3 DD |
| 3,848,988 | 11/1974 | Thetty et al. | 355/3 R |

*Primary Examiner*—Mervin Stein

[57] ABSTRACT

Developing apparatus for electrostatic type copying or reproduction machines using dry toner having heating means to heat the developing material whenever temperatures thereof fall below a preset minimum and/or humidity thereof rises above a preset maximum to thereby reduce humidity and absorption of moisture into the developing material. A controller operates the heating means in response to developing material temperatures and/or humidity conditions. Further control means prevents overheating of the developing material. In one embodiment, operation of the heating means is inhibited during operation of the reproduction machine while in another, the heating means is operated on a clock cycle.

7 Claims, 8 Drawing Figures

DEVELOPING SYSTEM FOR ELECTROSTATIC REPRODUCTION MACHINES

This invention relates to a developing apparatus for electrostatic reproduction machines, of the type using dry developing materials, and more particularly to an improved developing apparatus with humidity compensating means.

One type of electrostatic copying or reproduction machines employ a dry particulate mixture as material for developing the electrostatic latent images formed on the machine photoreceptor during the copying process. For this purpose, suitable applicating means such as one or more magnetic brushes, are used to bring the developing material into operative relationship with the machine photoreceptor to develop the latent electrostatic images thereon.

The developing material normally comprises relatively larger carrier beads, which may be metal, and relatively smaller dry ink particles. Due to the triboelectric relationships between the two, the smaller ink particles attach themselves to the carrier in great numbers. As the developing material is brought into juxtaposition with the photoreceptor surface, electrostatic charges on the photoreceptor tends to separate the ink particles from the carrier and deposit the same onto the photoreceptor in accordance with the latent image charge pattern. The carrier, some of which may be denuded or partially denuded, is returned to the developer sump for replenishing with ink particles.

In the type reproduction machines considered here, as alluded to above, the developing material is dry. Exposure to moisture, as in environments having relatively high humidity, may adversely affect performance of the developing material with attendant degradation in copy quality. As is known, electrostatic forces are affected by ambient humidity conditions, with electrostatic forces most effective in low humidity environments. And since humidity is associated with moisture, high humidity may expose the dry ink particles to sufficient moisture as to adversely affect the transfer ability of the dry ink particles.

It is therefore, a principle object of the present invention to provide a new and improved developing apparatus for use with dry developing materials.

It is an object of the present invention to provide a developing apparatus incorporating means to offset or reduce the effect of humidity changes on the developing material.

It is an object of the present invention to provide a developing apparatus incorporating means to warm the developing material.

It is an object of the present invention to provide means to make the developing material used in dry electrostatic copying process relatively insensitive to changes in relative humidity.

It is an object of the present invention to provide a mechanism for heating the developing material used in electrostatic type reproduction machines in periods of high humidity.

It is a further object of the present invention to provide a heater for warming the developer used in an electrostatic type copier during machine off hours.

This invention relates to a developing apparatus for bringing developing material into developing relationship with the photosensitive member of an electrostatic type reproduction or copying machine to thereby render latent electrostatic images on the photosensitive member visible, comprising in combination, a housing adapted to hold developing material for use in developing latent electrostatic images, means to heat the housing and the developing material therein to offset the effect of humidity on the developing material, and control means for actuating the heating means on a predetermined low developing material temperature or predetermined humidity level.

Other objects and advantages will be apparent from the ensuing description and drawings in which.

Figure 1:
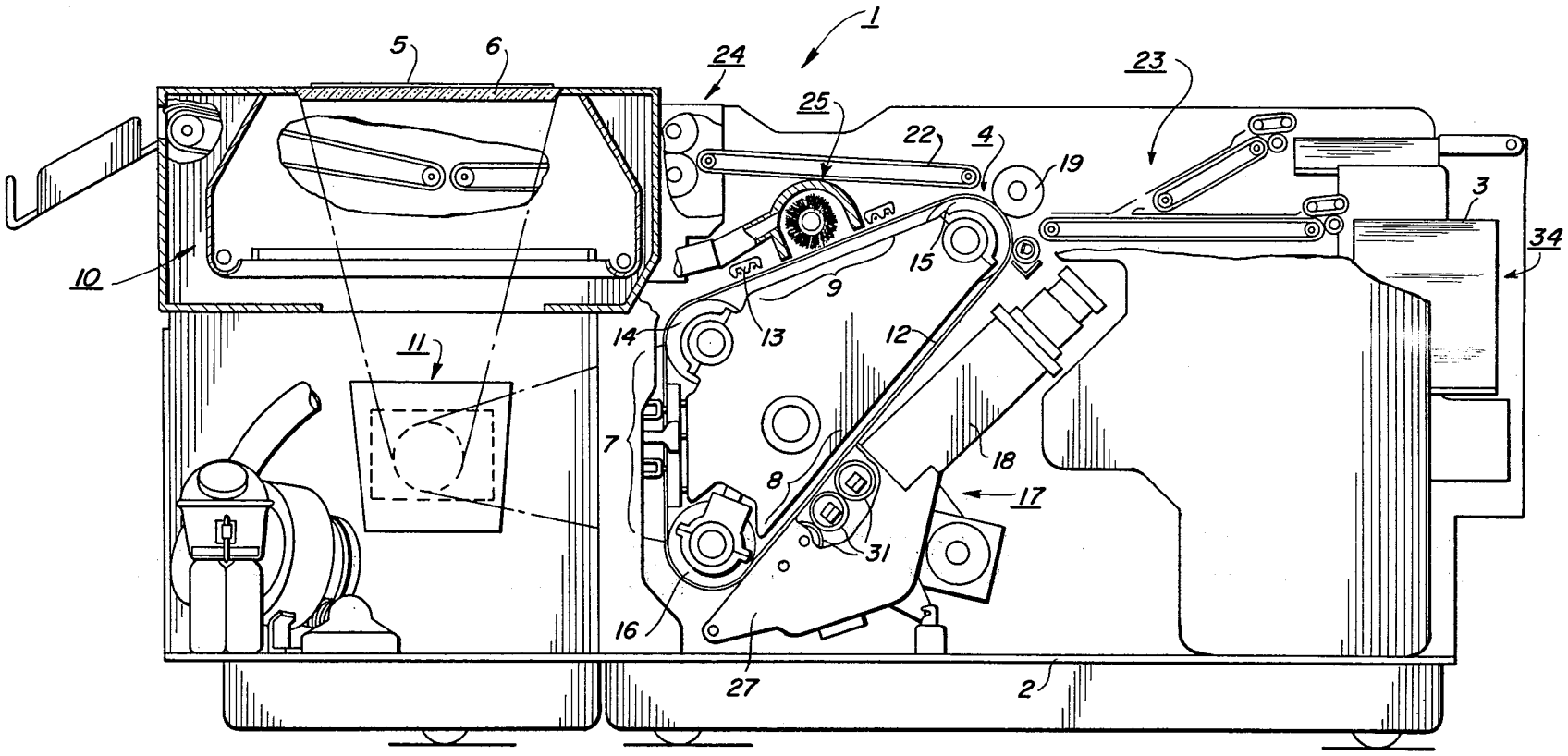
FIG. 1 is a schematic sectional view of an electrostatic reproduction machine embodying the principles of the invention.

For a general understanding of an electrostatic processing system in which the invention may be incorporated, reference is had to FIG. 1 in which various components of a system are schematically illustrated. As in all electrostatic systems such as a xerographic machine 1 of the type illustrated, a light image of an original to be reproduced is projected onto the sensitized surface of a xerographic plate to form an electrostatic latent thereon. Thereafter, the latent image is developed with an oppositely charged developer or developing material 29 (shown in FIG. 4) comprising carrier beads and smaller toner particles triboelectrically adhering thereto to form a xerographic powder image, corresponding to the latent image on the plate surface. The powder image is then electrostatically transferred to a support surface to which it may be fixed by a fusing device whereby the powder image is caused permanently to adhere to the support surface.

The electrostatically attractable developing material 29 commonly used in magnetic brush developing apparatus comprises a pigmented resinous powder referred to here as "toner" and a "carrier" of larger granular beads formed with steel cores coated with a material removed in the triboelectric series from the toner so that a triboelectric charge is generated between the toner powder and the granular carrier. The magnetizable carrier also provides mechanical control for the formation of brush bristles by virtue of magnetic fields so that the toner can be readily handled and brought into contact with the exposed xerographic surface. The toner is then attracted to the electrostatic latent image from the carrier bristles to produce a visible powder image on an insulating surface.

In the illustrated machine, an original 5 to be copied is placed upon a transparent support platen 6 fixedly arranged in an illumination assembly generally indicated by the reference numeral 10. While upon the platen, an illumination system flashes light rays upon the original thereby producing image rays corresponding to the informational areas on the original. The image rays are projected by means of an optical system 11 to an exposure station 7 for exposing the photosensitive surface of a moving xerographic plate in the form of a flexible photoconductive belt 12. The belt is uniformly charged by a corona device 13 located at a belt run extending between belt supporting rollers 14 and 15. The exposure station extends between the roller 14 and a third support roller 16.

The exposure of the belt surface to the light image discharges the photoconductive layer in the areas struck by light, whereby there remains on the belt 12 a latent electrostatic image in image configuration corresponding to the light image projected from the original 5 on the supporting platen. As the belt surface continues its movement, the electrostatic image passes around the roller 16 and through a developing station 8 located at a third run of the belt and in which there is positioned a developing apparatus generally indicated by the reference numeral 17. Suitable means (not shown) such as, vacuum panels or tensioning means may be utilized for maintaining the belt 12 flat through exposure, developing, and cleaning stations 7, 8 and 9 respectively. The developing apparatus 17 comprises a plurality of magnetic brushes 31 which carry developing material 29 to the adjacent surface of the upwardly moving inclined photoconductive belt 12 in order to provide development of the electrostatic image.

As the developing material is applied to the xerographic belt, toner particles in the development material are attracted electrostatically to the belt surface to form powder images. As toner powder images are formed additional toner particles are supplied to the developing material in proportion to the amount of toner deposited on the belt during xerographic processing. For this purpose, a toner dispenser generally indicated by reference numeral 18 is used to accurately meter toner, upon demand, to the developer material 29 in the developing apparatus 17.

The developed electrostatic image is transported by the belt 12 to a transfer station 4 located at a point of tangency on the belt as it moves around the roller 15 whereat a sheet of copy paper 3 is moved at a speed in synchronism with the moving belt in order to accomplish transfer of the developed image. There is provided at this station a transfer roller 19 which is supported on frame 2 of the machine 1 for contacting the nontransfer side of each sheet of copy paper as the same is brought into transfer engagement with the belt 12. The roller 19 is electrically biased with sufficient voltage so that a developed image on the belt 12 may be electrostatically transferred to the adjacent side of a sheet of paper 3 as the same is brought into contact therewith, and also for temporarily tacking the same on the roller 19.

There is also provided a suitable sheet transport mechanism adapted to transport sheets of paper 3 seriatim from a paper handling mechanism generally indicated by the reference numeral 23 to the developed image on the belt as the same is carried around the roller 15. A programming device operatively connected to the mechanism 23, and the illumination device for producing an electrostatic latent image on the belt 12 is effective to present a developed image at the transfer station 4 in timed sequence with the arrival of a sheet of paper.

After the sheet is stripped from the belt 12, it is conveyed by the conveying system 22 into a fuser assembly generally indicated by the reference numeral 24 wherein the developed and transferred xerographic powder image on the sheet material is permanently affixed thereto. After fusing, the finished copy is discharged from the apparatus at a suitable point for collection externally of the apparatus. The toner particles remaining as residue from the developed images, background particles, and those particles otherwise not transferred are carried by the belt 12 to cleaning station 9. There is a cleaning device 25 comprising a rotating brush, a corotron for neutralizing charges remaining on the particles and discharge lamp for discharging any remaining electrostatic charges on the belt 12 clean in preparation for reimaging.

Figure 2:
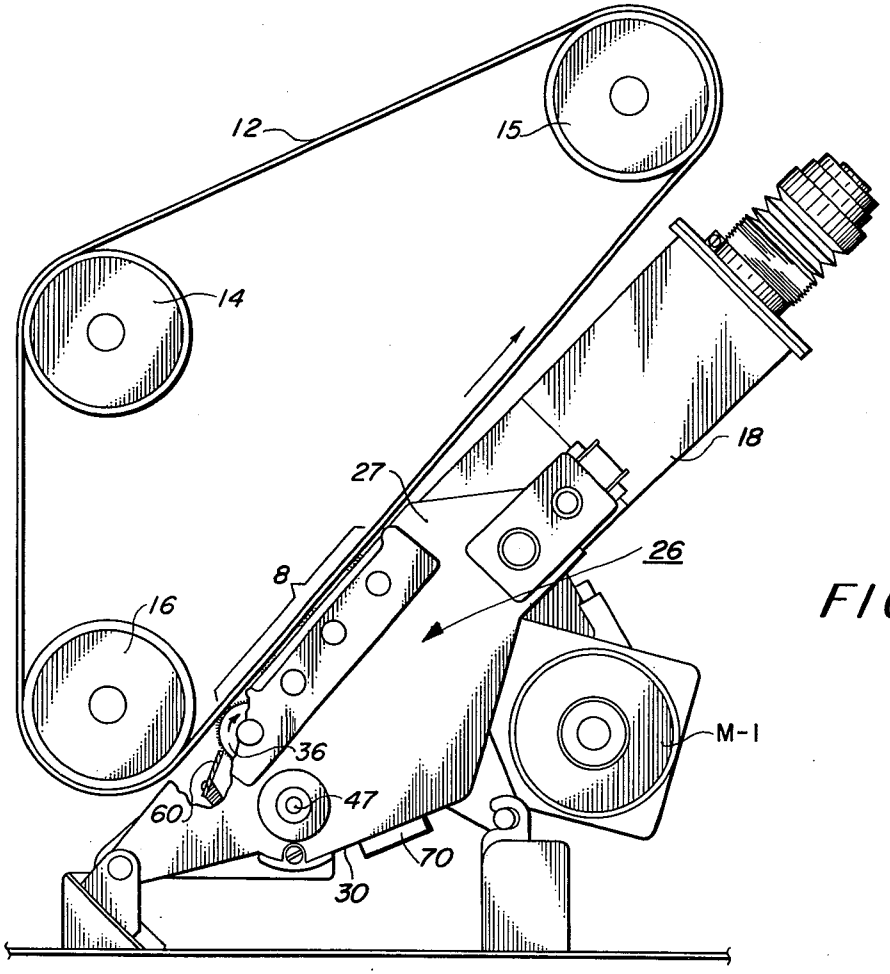
FIG. 2 is an enlarged elevational view of a magnetic brush developing apparatus utilized in the machine shown in FIG. 1, with parts broken away.
Figure 3:
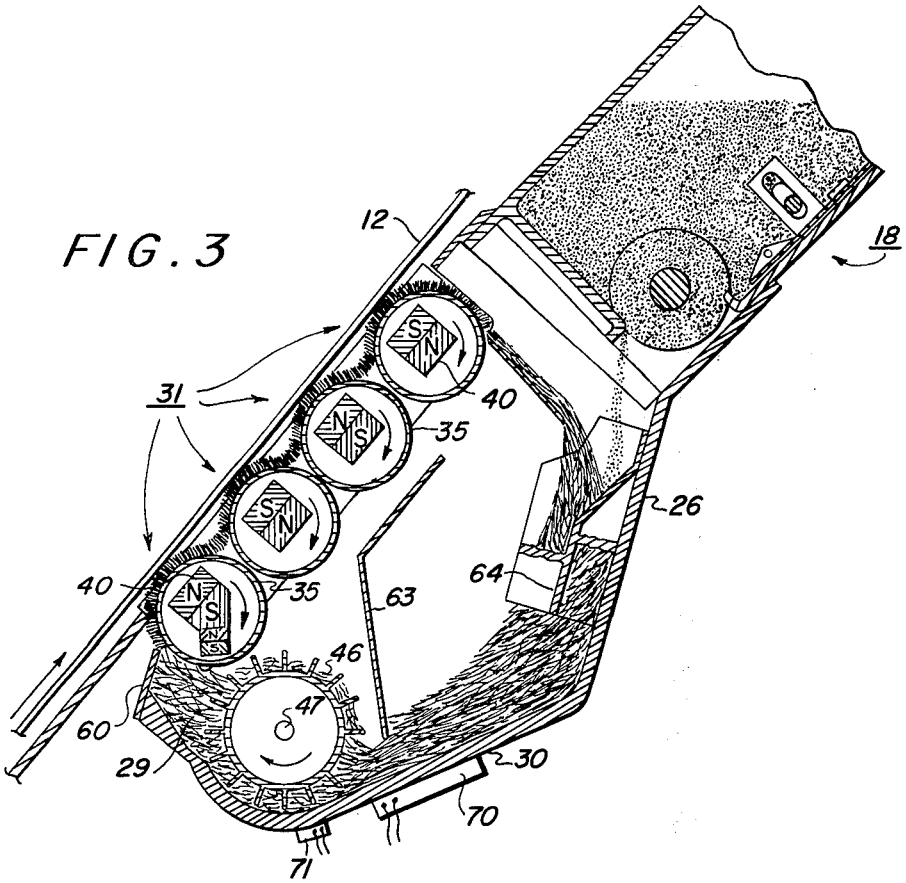
FIG. 3 is a partial sectional view of the magnetic brush developing system showing the developer heater of the present invention.

As shown in FIGS. 2 and 3, the developing apparatus includes a housing 26 having a generally rectangular cross section and a length extending beyond the width of the belt 12. The housing 26 is substantially closed except for an opening adjacent the photoconductive belt 12 whereat development of the latent image is effected. This housing serves as a container, closed at its ends, by end walls 27 and 28 and supporting an inclined bottom wall 30 for containing developing material comprising carrier beads from magnetizable material and colored electrostatic toner particles electrostatically adhering thereto.

Mounted for rotation within the developer housing are a series of magnetic brushes 31, positioned with their axes in parallel and below the selenium belt 12. The magnetic brushes 31 each include an outer cylinder 35, made of nonmagnetizable material and extending almost the length of the housing 26, mounted for rotation by and between the end walls 27, 28.

Within each cylinder 35 there is positioned suitable magnets 40, extending nearly the full length of the cylinder and being mounted therein for rotation relative to the cylinder 35 associated therewith. A suitable external control device may be provided for rotating the magnets for adjusting the magnetic field orientation.

In operation during development, the brush cylinders 35 are rotated by way of a drive shaft 38 and the magnets 40, remain stationary. The brush bristles produced by the influence of the magnetic field emanating from the magnets acting upon the magnetizable carrier beads in the developing material 29 will form on the upper region of the cylinders 35 between the cylinders and the undersurface of the selenium belt 12. As a result, a "magnetic blanket" extending continously over all of the brushes 31 for the entire width of the development station 8 is formed.

Figure 4:
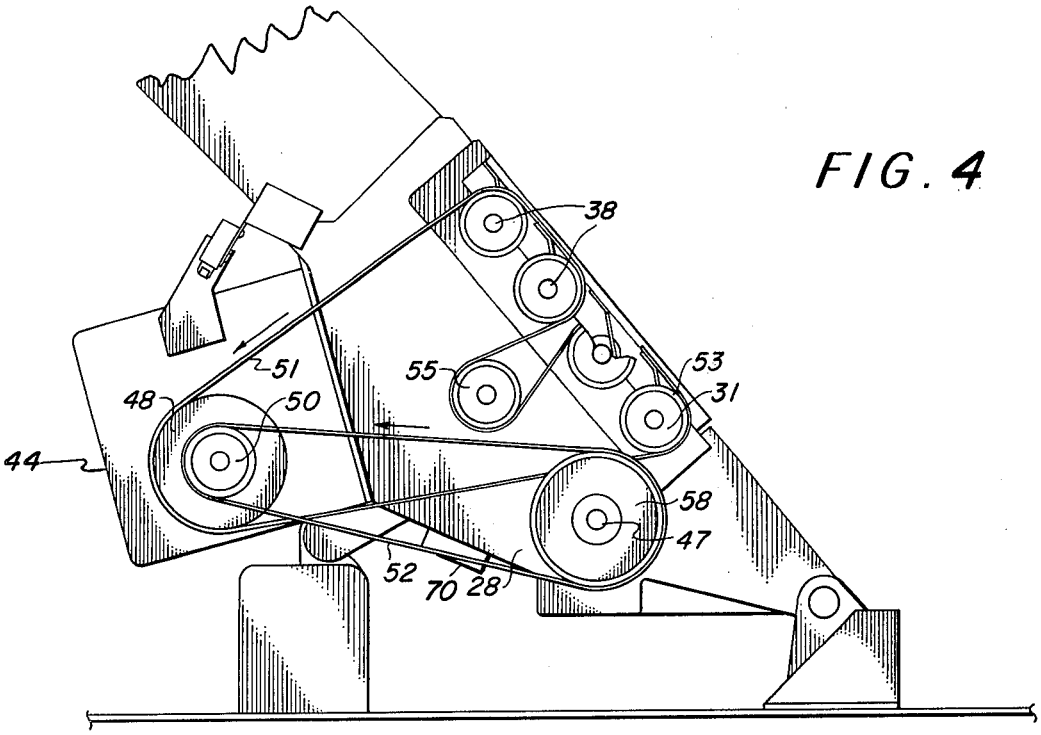
FIG. 4 is an elevational view of another side of the housing shown in FIG. 3 and showing the drive mechanism for the magnetic brushes.

Also mounted within the development housing 26 and below the magnetic brushes 31 is a paddle wheel impeller 46 having a plurality of blades radially extending therefrom and having its ends rotatably mounted in the end walls 27, 28 by means of a drive shaft 47. During development, the impeller 46 is rotated in the direction shown by the arrow in FIG. 3 and serves to transport the developing material toward magnetic brushes 31 independent of the state of levelness and the amount of carrier beads in the system. The rotational motion for the various rotary components of the developing apparatus 17, as illustrated in FIG. 4 is derived by a motor 44 and a drive system comprising a pulley 48 secured to the shaft of the motor, a smaller pulley 50 also secured to the shaft, and timing belts 51, 52 for connecting the pulleys 48, 50 respectively, to the rotary components. Specifically, the belt 51 is drivingly engageable with suitable pulleys 53, mounted on the drive shafts for each of the magnetic brush cylinders 31, and idler pulley 55. With this arrangement, the magnetic brush cylinders rotate with the same peripheral speeds, in the same direction and in a direction which moves the "magnetic blanket" comprising magnetic brush bristles upwardly in an inclined plane arranged at the same angle as the angle of the plane which the belt 12 assumes in the development run. A timing belt 52 connects the drive pulley 50 with a driven pulley 58 secured to the shaft 47 for the impeller 46 thereby assuring that the impeller and the magnetic brush cylinders move in unison.

Suitable baffle members 63, 64 direct returning developing material 29 back into juxta-position with paddle wheel 46.

As described, developing material 29 consists of a relatively larger carrier, normally made of metal and in the form of a bead, and relatively smaller particles of dry ink, called toner. The humidity of the area within which the developer material is placed may, to a greater or lesser degree, affect the way in which the developing material develops the latent electrostatic images formed on belt 12. This in turn could affect the quality of the copies produced, which visually may appear as copies that are either too light or too dark. Particularly significant are conditions of high humidity.

The effect of humidity, particularly high humidity, is most evident immediately after the machine is started up following a relatively long shutdown, i.e. overnight or after a weekend. Following operation of the machine for a period of time, the humidity of the developing material normally declines, due in part at least to the exposure to internal machine heat.

To enable humidity conditions of the developing material to be regulated, a source of heat as an electric resistance type heater 70 is supported on the exterior of developer housing 26 in heat exchange relationship therewith. Since the bulk of the developing material 29 is normally disposed in the lower or sump portion of developer housing 26, heater 70 is preferably disposed adjacent the housing lower portion. Preferably, heater 70 is of a size sufficient to extend across substantially the entire width of housing 26 to assure uniform heating of the entire housing area, the capacity of heater 70 being sufficient to sustain the temperature of the developing material at a preset temperature under given ambient temperature conditions.

Figure 5:
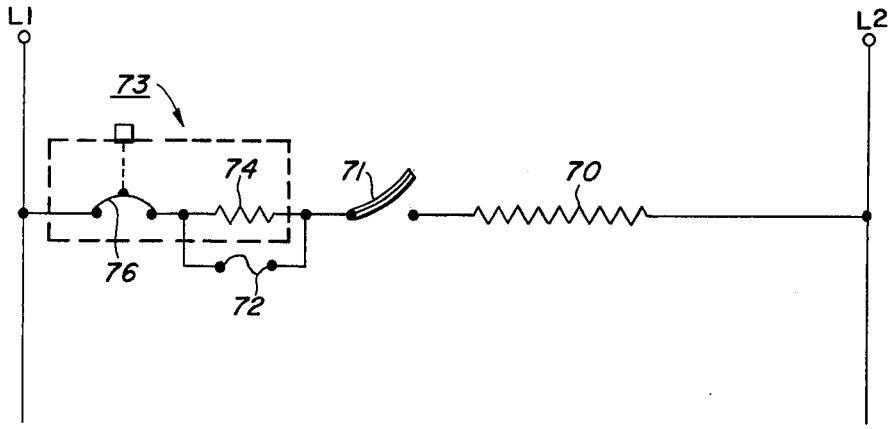
FIG. 5 is a schematic illustration of a control circuit for the developer heater of the present invention.

Referring now to the control schematic shown in FIG. 5, heater 70 is connected across a suitable source of electrical energy, represented by leads $L_1$, $L_2$ through a controlling thermostatic switch 71 and contact 72 of a suitable circuit breaker 73. Thermostatic switch 71 is arranged to respond to temperature conditions of the developing material, and for this purpose is supported upon and in heat exchange relation with developer housing 26. Switch 71 is arranged to close and complete the circuit to heater 70 at or below a preset minimum temperature and to open to interrupt the circuit to heater 70 at or above a preset maximum temperature. One suitable temperature has been found to be 98° F minimum and 108° F maximum.

Circuit breaker 73 may comprise any suitable commercially available circuit protector such as a thermal type breaker having a line current sensitive resistance heating element 74 with temperature responsive line switch 72. As will be understood by those skilled in the art, heat from resistor 74 at or above a preset maximum line current triggers switch 72 to interrupt the circuit to heater 70. Preferably, circuit breaker 73 incorporates manual switch contacts 76 to enable the circuit to heater 70 to be manually opened.

In operation, thermostatic switch 71 responds to temperature conditions of the developer housing 26 to energize heater 70 whenever the temperature of the housing and the developing material therewithin falls below a preset minimum. Heat from heater 70 warms the developer housing 26 and the developing material therewithin which in turn reduces the tendency of the developing material to absorb moisture.

When temperatures of the developer housing reach or are at a preset maximum level, thermostatic switch 71 opens to interrupt the circuit to heater 70.

It will be understood that the minimum closing temperature of thermostatic switch may be chosen so that effectively switch 71 is normally closed, and opens only on the attainment of the preset maximum temperature setting. In this arrangement, heater 70 would normally be continuously operated as in the case of a reproduction maching having relatively low or non-existant internal heat buildup.

Figure 6:
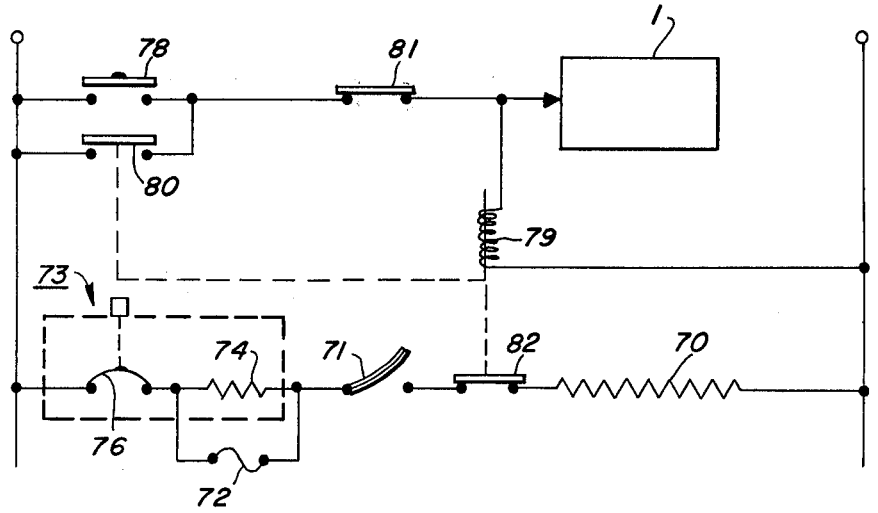
FIG. 6 is a schematic illustration of a modified control circuit.

In the embodiment shown in FIG. 6, where like numerals designate like parts, energization of heater 70 is foreclosed during operation of reproduction machine 1. Referring thereto, a print/start switch 78 for actuating reproduction machine is provided, closure of switch 78 triggering holding relay 79. Contact 80 of relay 79, which is closed on energization of relay 79, establishes a holding circuit around print/start switch 78 permitting switch 78 to be released. A suitable machine "off" contact 81 is provided. To inhibit energization of heater 70 during operation of reproduction machine 1, a second relay contact 82 is interposed in the heater energizing circuit. Contact 82, which may be normally closed, is opened by relay 79 whenever relay 79 is energized.

Figure 7:
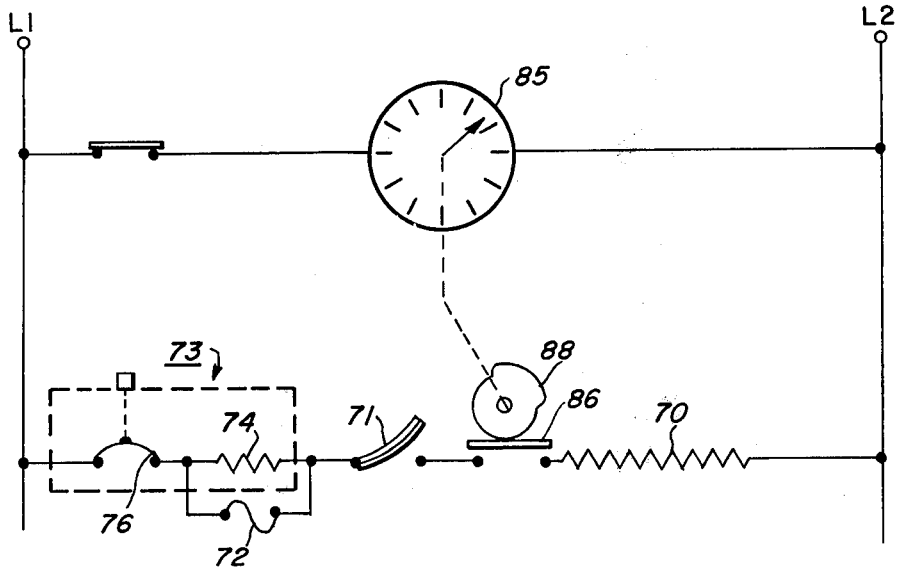
FIG. 7 is a schematic illustration of a second modified control circuit.

In the embodiment shown in FIG. 7, a timing control is provided for energizing heater 70, as during machine off hours, i.e. nights. Referring to FIG. 7, where like numerals designate like parts, a suitable timing device or clock 85 is provided. Contact 86 of clock 85 is disposed in the energizing circuit to heater 70, contact 86 being opened and closed at preselected times by a suitable clock operating mechanism, illustrated schematically by cam 88.

In operation, clock 85 is preset to close contact 86 thereof at a preselected time, i.e. 10 P.M. and to retain contact 86 closed for a predetermined interval, i.e. until 6 A.M. Closure of thermostatic switch 71 during this period completes an energizing circuit through contact 86 to heater 70 to energize the heater and warm the developing material in developer housing 26. It is understood that suitable switch means may be provided to disable heater 70 during operation of reproduction machine 1 as in the embodiment of FIG. 7.

Figure 8:
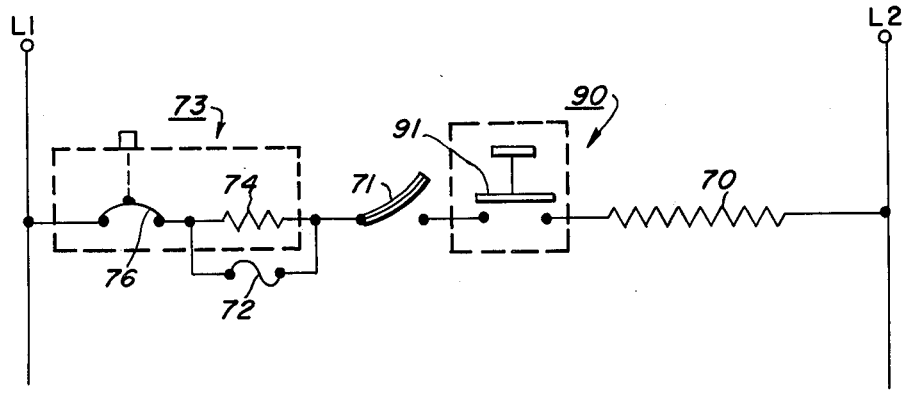
FIG. 8 is a schematic illustration of a third modified control circuit.

In the embodiment illustrated in FIG. 8, where like numerals refer to like parts, operation of heater 70, is in response to humidity conditions of the air or atmosphere adjacent developer housing 26 as sensed by humidstat 90. Humidistat 90 includes a switch contact 91 arranged in series with thermostatic switch 71 and circuit breaker 73 across leads $L_1$, $L_2$. Humidistat 90, which is disposed so that the humidity responsive element thereof is exposed to the air at some convenient location adjacent developer housing 26, comprises any suitable commercially available humidity responsive device.

In operation of the FIG. 8 embodiment, humidistat 90 responds to humidity conditions of the air adjacent developer housing 26, and on a predetermined high relative humidity, closes switch contact 91 thereof. As previously described, thermostatic switch 71 will close on a preset low temperature of developer housing 26 and open on a preset high or maximum temperature. As described previously, the temperature of developer housing 26 reflects the temperature conditions of the developing material 29 therewithin. Closure of both thermostatic switch 71 and humidistat switch contact 91 completes an energizing circuit to heater 70 (presuming circuit breaker 73 is closed) to warm the developer housing 26 and the developing material therewithin. This condition prevails until such time as thermostatic switch 71 or switch contact 91 of humidistat 90 opens reflecting attainment of the preset maximum developer housing temperature or reduction of the relative humidity circumadjacent developer housing 26 to a preset level respectively.

It will be understood that additional switch means may be provided to disable heater 70 whenever reproduction machine 1 is in use irrespective of developer temperatures or humidity conditions.

While the invention has been described with reference to the structure disclosed, it is not confined to the details set forth, but is intended to cover such modifications or changes as may come within the scope of the following claims.

What is claimed is:

1. In a developing apparatus for an electrostatic reproduction machine adapted to produce copies of an original and having a photosensitive member on which latent electrostatic images of the original are formed, with means to bring relatively dry particulate developing material into developing relationship with the machine photosensitive member to develop the images on the photosensitive member, the improvement comprising:

means to control humidity conditions of said developing material whereby to assure optimum development of said images despite changes in relative humidity, said humidity control means including a heater for heating said developing material, means for actuating said heater on a predetermined low temperature of said material, and timing means for restricting actuation of said heater to preset time intervals.

2. In a developing apparatus for an electrostatic reproduction machine adapted to produce copies of an original and having a photosensitive member on which latent electrostatic images of the original are formed, with means to bring relatively dry particulate developing material into developing relationship with the machine photosensitive member to develop the images on the photosensitive member, the improvement comprising:

means to control humidity conditions of said developing material whereby to assure optimum development of said images despite changes in relative humidity, said humidity control means including a heater for heating said developing material, and timing means for actuating said heater at preset intervals.

3. The developing apparatus according to claim 2, including temperature responsive means adapted on a preset temperature condition of said developing material to intervene and render said heater inoperative.

4. In a developing apparatus for an electrostatic reproduction machine adapted to produce copies of an original and having a photosensitive member on which latent electrostatic images of the original are formed, with means to bring relatively dry particulate developing material into developing relationship with the machine photosensitive member to develop the images on the photosensitive member, the improvement comprising:

means to control humidity conditions of said developing material whereby to assure optimum development of said images despite changes in relative humidity, said humidity control means including a heater for heating said developing material, and means for actuating said heater on a predetermined low temperature of said material, and means adapted during operation of said machine to intervene and render said heater inoperative.

5. The developing apparatus according to claim 4 in which said humidity control means includes a controller for energizing said heater, said controller including a first control element actuable in response to said predetermined low temperature of said developing material, and a second control element actuable in response to a preset relative humidity condition of the ambient adjacent said developing material, said controller being responsive to concurrent actuation of both said first and second control elements to energize said heater.

6. In a developing apparatus for an electrostatic reproduction machine adapted to produce copies of an original and having a photosensitive member on which latent electrostatic images of the original are formed, with means to being relatively dry particulate developing material into developing relationship with the machine photosensitive member to develop the images on the photosensitive member, the improvement comprising:

means to control humidity conditions of said developing material whereby to assure optimum development of said images despite changes in relative humidity, said humidity control means including a heater for heating said developing material, and means for energizing said heater to reduce humidity of said developing material, said heater energizing means including circuit means effective when completed to energize said heater, first switch means in said circuit means actuable in response to a predetermined low temperature of said developing material, and a second switch means in said circuit means in series with said first switch means, said second switch means being actuable in response to a predetermined high relative humidity of the ambient adjacent said developing material, concurrent actuation of said first and second switch means completing said circuit means to energize said heater.

7. The developing apparatus according to claim 6, in which said humidity control means includes third switch means in said circuit means effective on a predetermined overtemperature of said developing material to interrupt said circuit means and render said heating inoperative.

* * * * *